US006382596B1

(12) United States Patent
D'Ath

(10) Patent No.: US 6,382,596 B1
(45) Date of Patent: May 7, 2002

(54) SECURITY FENCE

(75) Inventor: James Ellerslie D'Ath, Queensland (AU)

(73) Assignee: Neumann Steel Pty Ltd., Queensland (AU)

( * ) Notice: Subject to any disclaimer, the term of this patent is extended or adjusted under 35 U.S.C. 154(b) by 0 days.

(21) Appl. No.: 09/582,080

(22) PCT Filed: Dec. 22, 1998

(86) PCT No.: PCT/AU98/01061

§ 371 Date: Jun. 22, 2000

§ 102(e) Date: Jun. 22, 2000

(87) PCT Pub. No.: WO99/32742

PCT Pub. Date: Jul. 1, 1999

(30) Foreign Application Priority Data

Dec. 22, 1997 (AU) ..... PP1061

(51) Int. Cl.[7] ..... E04H 17/00

(52) U.S. Cl. ..... 256/11; 256/3

(58) Field of Search ..... 256/11, 12, 2, 256/3

(56) References Cited

U.S. PATENT DOCUMENTS

| | | | | | |
|---|---|---|---|---|---|
| 2,345,771 | A | * | 4/1944 | Reynolds | 256/12 |
| 3,437,059 | A | * | 4/1969 | Stonier et al. | 256/65 X |
| 3,861,084 | A | * | 1/1975 | Ford | 256/12 X |
| 4,081,177 | A | * | 3/1978 | Graff | 256/12 |
| 5,143,354 | A | * | 9/1992 | Nolan | 256/12 |

* cited by examiner

*Primary Examiner*—Lynne H. Browne
*Assistant Examiner*—John R. Cottingham
(74) *Attorney, Agent, or Firm*—Young & Thompson

(57) ABSTRACT

A security fence includes a panel of chain wire mesh supported by posts having lower portions and upper portions. The lower portions and the upper portions of the fence posts are connected by a flexible member so that the upper portions are resiliently deflectable. The upper portions support a barrier of barbed wire. The flexible member and the upper portions are located above adult height so that efforts to climb the fence causes the upper portions to resiliently deflect down onto the person attempting to climb the fence.

17 Claims, 4 Drawing Sheets

SECURITY FENCE

FIELD OF INVENTION

THIS INVENTION relates in particular but is not limited to a security fence.

BACKGROUND ART

Security fences are commonly known barriers to restrict or prevent the access or egress of unauthorised persons to or from a fenced area such as for the protection of property and belongings. Security fences are also used to confine persons such as inmates of a prison or detainees of a detention centre to a confined area. The effectiveness of prior art security fences is often limited to the height of the fence and whether the fence includes other barriers or obstacles such as barbed wire or razor wire to deter climbing over them. In many cases security fences with such barriers can often be overcome by simply placing a heavy mat or similar material over the barbed wire or razor wire. In order to overcome this problem, prior art security fences often have a barrier of barbed wire at the top of the fence which is also angled away from the fence. Commonly, the fence may in fact have two barriers of barbed wire in a Y shaped configuration to make the fence more difficult to climb across. Even where the Y shaped barrier is used, determined climbers can still cross these barriers by placing heavy mats over them.

Australian Patent No. 237170 describes a flexible guide post employing a coil spring fitted into a concrete footing. U.S. Pat. No. 4,605,204 describes a collapsible recreational fence employing a resilient plastics mesh with plastic posts. German Patent No. DE 3834817 describes a security fence with small springs allowing limited deflection of an upper part of the fence to activate a microswitch to detect intruders. UK Patent No. 1354057 describes a security fence where strain gauges detect interference with the fence. U.S. Pat. No. 1,336,680 describes a fence post used to allow passage of driftwood to prevent the fence being damaged during floods. U.S. Pat. No. 5,597,262 describes a resiliently deflectable traffic bollard with rotatable collar.

While the above referenced patents describe various forms of post and fence deflections they are either expensive to manufacture or are unsuitable as part of a security fence of the chain wire type. The present invention provides a security fence that is economical to construct as an alternative to existing security fences and provides a resiliently deflectable upper portion positioned above head height secured to a rigid lower portion to inhibit unauthorised persons from climbing over the fence.

OBJECT OF THE INVENTION

It is therefore an object of the invention to overcome to some degree the problems associated with prior art security fences.

SUMMARY OF THE INVENTION

In a preferred aspect the invention resides in a security fence having the improvement of fence posts comprising upper and lower portions; the portions connected by a flexible member biased to keep the upper portion in one position relative to the lower portion, wherein in operation, force or weight applied to the upper portion causes the upper portion to collapse in the direction of the force or weight; the upper portion returning to its original position on removal of the force or weight.

Preferably there is provided a security fence comprising spaced posts extending above adult head height, each post having an upright rigid lower portion and a resiliently deflectable upper portion, a major portion of the length of said posts comprising the lower portion and the upper portion having a lower marginal section thereof above head height, barrier material interconnecting the lower portions of adjacent posts to prevent unauthorised access other than by passing over the security fence, barrier means interconnecting the upper portions of adjacent posts, the upper portions resiliently deflecting under load to inhibit unauthorised passage over the security fence. Preferably the upper portion is joined to the lower portion by a resilient connector. Preferably the resilient connector comprises a coil spring and coupling collars extending over marginal end portions of the coil spring and coupling opposite ends of the coil spring to the upper and lower post portions respectively.

Preferably the upper portions comprise Y-shaped terminal sections with barrier means extending between respective arms of said Y-shaped terminal portions of adjacent posts.

Preferably the upper portions are adapted to deflect through an angle of greater than 45°.

In another preferred aspect the invention resides in a security fence comprising:

at least two spaced upright posts;

the posts having an upper portion and a lower portion;

the upper and lower portions connected by a flexible member biased to keep the upper portion in one position relative to the lower portion;

a panel member spanning between the lower portions of the posts;

a barrier member spanning between the upper portions of the posts, wherein in operation, force applied to the barrier member or the upper portion of the posts causes the barrier member and the upper portion to collapse in the direction of the force;

the barrier member and the upper portions returning to their original position on removal of the force or weight.

Preferably the posts are galvanised iron of circular or square cross sectional profile.

The upper portion is preferably shorter in length than the lower portion of the posts. The upper portion may be in vertical alignment with the lower portion or may be angled away from the lower portion. In the alternative, the upper portion may comprise of two or more sections of post, the sections splayed relative to each other in a V or Y shaped configuration.

In preference the flexible member which biases the upper portion to remain in one position relative to the lower portion of the posts is a coiled spring however other types of flexible members may be used.

Preferably the flexible member is connected to the upper and lower portions by one-way security fasteners which require a special tool for their installation and removal. Other methods of connection such as welding the flexible member directly to the upper and lower portions may also be used. Alternatively, if ordinary fasteners such as hexagonal nuts and bolts are used, the nuts maybe deformed or burred over to discourage removal.

Suitably the barrier member comprises one or more rows of barbed wire or razor wire.

Preferably the panel member is wire mesh however timber or other panel material may be used.

BRIEF DESCRIPTION OF THE DRAWINGS

In order that the present invention be more readily understood and be put into practical effect, reference will now be made to the accompanying drawings where.

DETAILED DESCRIPTION OF DRAWINGS

Figure 1:
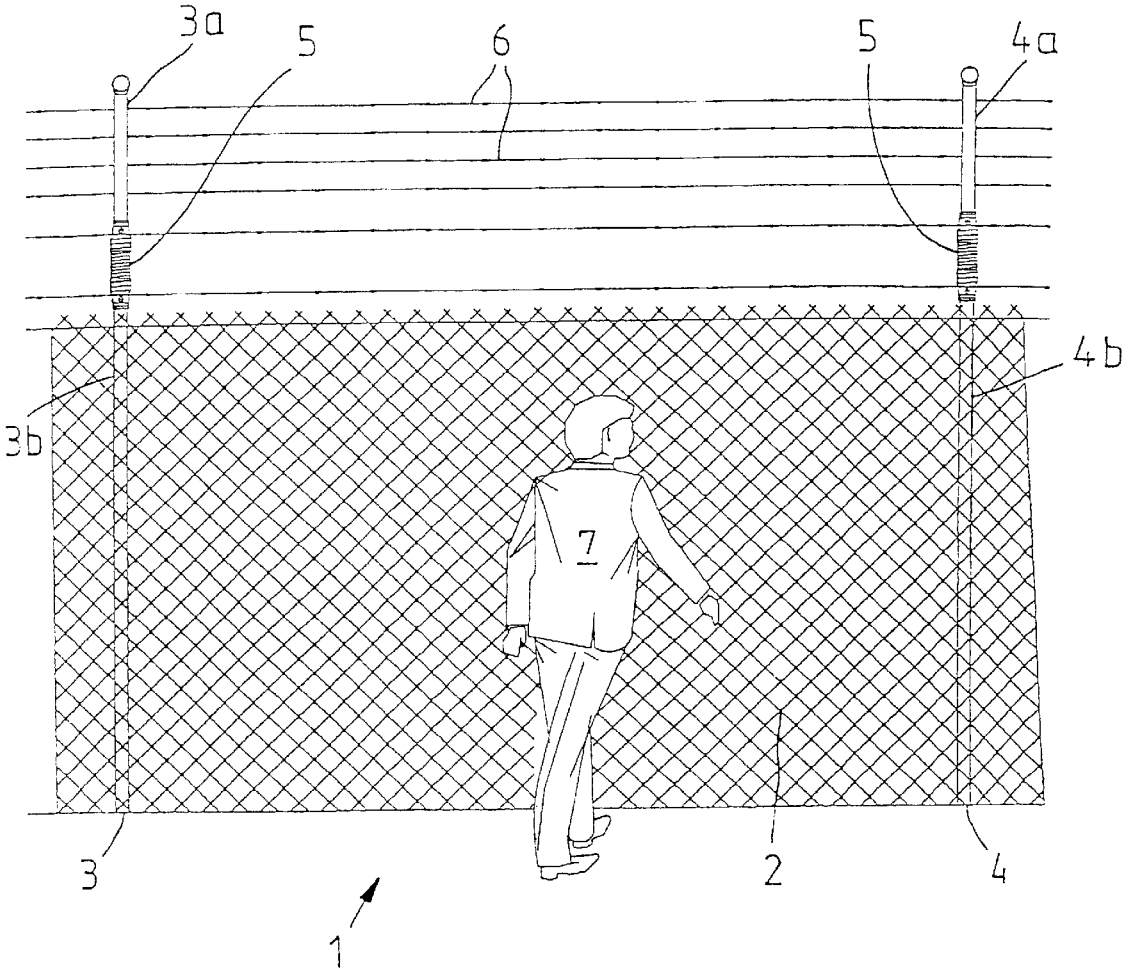
FIG. 1 is a front elevation of the security fence according to the invention.

Referring now to the accompanying illustrations and initially to FIG. 1 there is illustrated a security fence 1 comprising a panel of wire mesh 2 supported by posts 3, 4 comprising lower portions 3*b*, 4*b* and upper portions 3*a*, 4*a*. The lower portion 3*b*, 4*b* and the upper portion 3*a*, 4*a* of the fence posts are connected by a flexible member 5. The upper portions support a barrier of barbed wire 6. Also shown in this illustration is a representation of a man 7 of average height for height reference purposes.

Figure 2:
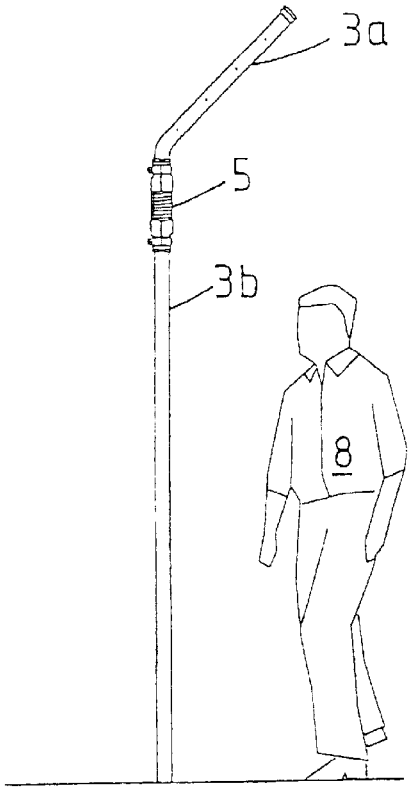
FIG. 2 is a side elevation of the fence of FIG. 1.

FIG. 2 shows a side elevation of the fence of FIG. 1. In this embodiment the upper portion 3*a* of the fence post is angled away from the vertical and is connected to the lower portion 3*b* of the fence post by the flexible member 5. Also shown for height reference purposes is the figure of a man 8.

Figure 3:
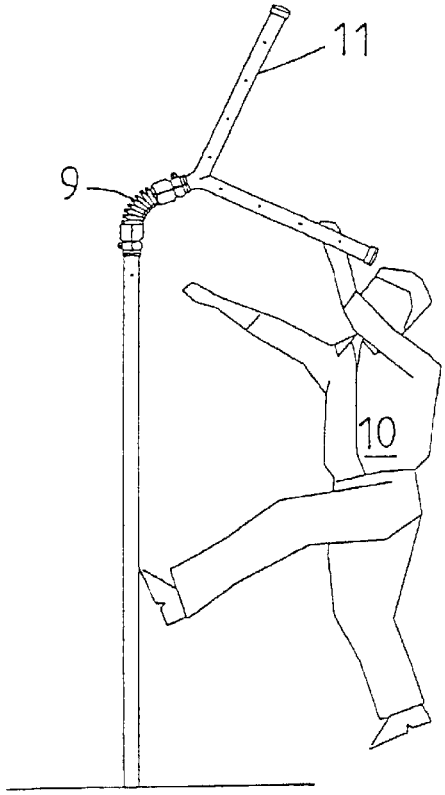
FIG. 3 is a side elevation showing the operation of the invention.

FIG. 3 shows the operation the flexible member 9 when the weight of the climber 10 causes the Y-shaped upper portion 11 to collapse in the direction of the climber 10.

Figure 4:
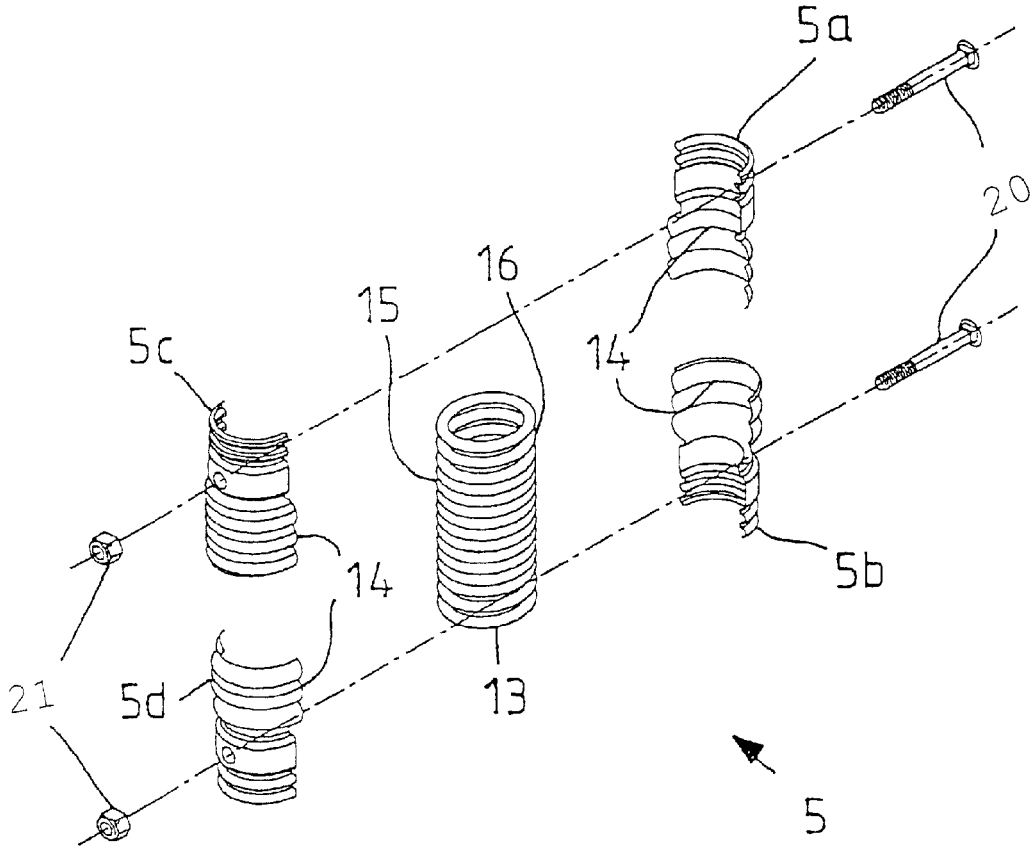
FIG. 4 is an exploded view of the flexible member according to the invention.

FIG. 4 shows an exploded view of the flexible members. The flexible member 5 comprises a coil spring 13 which is affixed to upper and lower portions of a fence post (not shown) by means of semi-circular collars 5*a*, 5*b*, 5*c*, 5*d*. The semi-circular collars have a cross-sectional profile 14 to accommodate the coils 15, 16 of the spring 13 which are secured between the two semi-circular collars 5*a*, 5*b* and 5*c*, 5*d* by means of bolts 20 having nuts 21.

In this embodiment, ordinary nuts are shown which may be deformed or burred over to discourage removal. In the alternative, security nuts which require a special tool for their installation and removal may be used.

Figure 5:
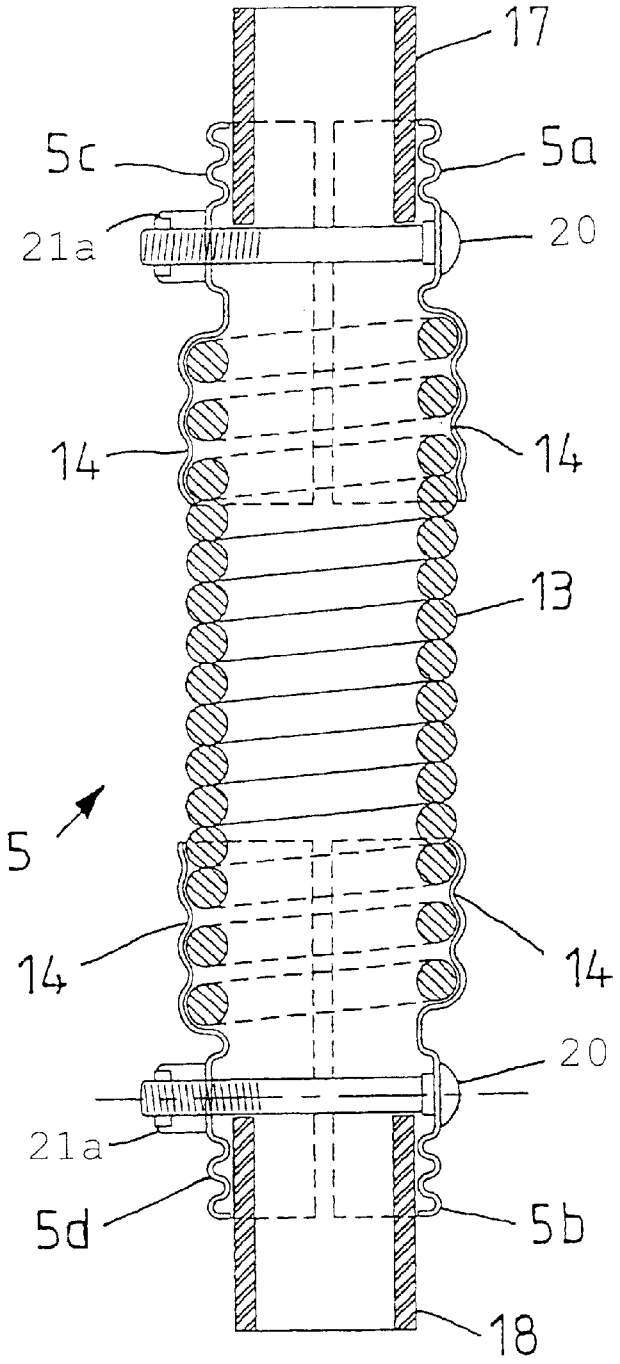
FIG. 5 is a cross sectional view of the flexible member according to the invention.

FIG. 5 shows a cross-sectional view of the flexible member 5 of FIG. 4 in the fully assembled position. In this view the coil spring 13 is securely held between the semi-circular collars 5*a*, 5*b* and 5*c*, 5*d* which have cross sectional profiles 14 to accommodate the coils of the spring 13.

Security nuts 21*a* are used to secure the bolts with the collars 5*a*, 5*b* and 5*c*, 5*d* against the coil spring 13 and the upper 17 and lower 18 portion of a post.

Whilst the above has been given by way of illustrative example of the present invention many variations and modifications thereto will be apparent to those skilled in the art without departing from the broad ambit and scope of the invention as herein set forth in the appended claims.

What is claimed is:

1. A security fence comprising:

a plurality of spaced posts, each of said plurality of spaced posts having an upright rigid lower portion and a resiliently deflectable upper portion able to deflect under a load;

a first barrier material interconnecting the lower portion of adjacent ones of said plurality of spaced posts to prevent unauthorized access other than by passing over the security fence;

a second barrier material interconnecting the upper portion of said adjacent ones of said plurality of spaced posts, each of said plurality of spaced posts having a coupling comprising an upper portion post connector and, spaced therefrom, a lower portion post connector connecting the upper and lower portions of each of said plurality of spaced posts together, the coupling having a biasing element between the upper and lower portion post connectors to return the coupling to an original start position after the load is released.

2. A security fence according to claim 1 wherein the upper portion is inclined to the lower portion.

3. A security fence according to claim 1, wherein the biasing element comprises a coil spring and the upper and lower portion post connectors each comprise a pair of coupling collars that are connected together and that bridge marginal end portions of the coil spring and marginal end portions of the upper and lower portions respectively.

4. A security fence according to claim 1 wherein each said upper portion comprises Y-shaped terminal sections having respective arms with barrier means extending between the respective arms of said Y-shaped terminal portions of adjacent ones of said plurality of spaced posts.

5. A security fence according to claim 1 wherein the upper portion is adapted to deflect through an angle of greater than 45°.

6. A security fence according to claim 1 wherein each said upper portion comprises Y-shaped terminal sections with barrier means extending between respective arms of said Y-shaped terminal portions of adjacent ones of said plurality of space posts, the upper portions being joined to the lower portions by resilient connectors, the resilient connectors comprising coil springs and coupling collars extending over marginal end portions of the coil springs and coupling opposite ends of the coil springs to the upper and lower portions respectively.

7. A security fence according to claim 1 wherein the biasing element is a coil spring extending axially inside the coupling, the coil spring deflecting from an axial position when the coupling is under the load and returning to the axial position when the load is released.

8. A security fence comprising:

a plurality of spaced posts each having an upright rigid lower portion and a resiliently deflectable upper portion that deflects under a load, the upper and lower portions being connected to each other by a coupling, the coupling comprising:

an upper post connector having a first end connecting the coupling to the upper portion;

a lower post connector having a first end connecting the coupling to the lower portion; and a coil spring connecting a second end of the upper post connector and a second end of the lower post connector, and being structured and arranged to return the coupling to an original start position after the load is released, the coil spring having ends that are not overlapped by the upper and lower portions, wherein the upper and lower post connectors have a cross-sectional profile that couples with the resilient member to secure the resilient member to the upper and lower post connectors.

9. The security fence as claimed in claim 8, further comprising first and second fastening members that fastens each of the upper and lower post connectors to respective ones of the upper and lower portions.

10. The security fence as claimed in claim 9, wherein the first and second fastening members are bolts.

11. The security fence as claimed in claim 8, wherein a diameter of the coiled spring is larger than an outside diameter of each of the plurality of spaced posts.

12. The security device as claimed in claim 9, further comprising:

a first barrier material interconnecting the lower portion of adjacent ones of said plurality of spaced posts to prevent unauthorized access other than by passing over the security fence; and a second barrier material interconnecting the upper portion of said adjacent ones of said plurality of spaced posts.

13. The security device as claimed in claim 8, wherein the resiliently deflectable upper portion deflects upon applying the load.

14. A security device comprising:

a plurality of spaced posts each having an upright rigid lower portion and a resiliently deflectable upper portion that deflects under a load;

a flexible member between the upper and lower portions; and a means for coupling the upper portion to the lower portion wherein the upper portion and the lower portion are spaced apart from one another.

15. The security device as claimed in claim 14, further comprising:

a first barrier material interconnecting the lower portion of adjacent ones of said plurality of spaced posts to prevent unauthorized access other than by passing over the security fence;

a second barrier material interconnecting the upper portion of said adjacent ones of said plurality of spaced posts.

16. The security device as claimed in claim 14, wherein the flexible member is a coiled spring.

17. The security device as claimed in claim 14, wherein the means for coupling is outside the upper and lower portions.

* * * * *